US007300149B2

(12) United States Patent
Hwang

(10) Patent No.: US 7,300,149 B2
(45) Date of Patent: Nov. 27, 2007

(54) WIDE-ANGLE DIVING LENS

(76) Inventor: Wen-Tong Hwang, 3F.-1, No.20, Wuquan 2nd Rd., Xinzhuang City, Taipei County 242 (TW)

( * ) Notice: Subject to any disclaimer, the term of this patent is extended or adjusted under 35 U.S.C. 154(b) by 0 days.

(21) Appl. No.: 11/255,968

(22) Filed: Oct. 24, 2005

(65) Prior Publication Data

US 2007/0091250 A1 Apr. 26, 2007

(51) Int. Cl.
*G02C 1/00* (2006.01)

(52) U.S. Cl. ..... 351/43; 2/430; 359/737

(58) Field of Classification Search ..... 351/41, 351/43, 159; 2/430; 359/708, 720, 737
See application file for complete search history.

(56) References Cited

U.S. PATENT DOCUMENTS 4,704,014 A * 11/1987 Carner, Jr. ..... 351/43
5,420,649 A * 5/1995 Lewis ..... 351/43
6,921,164 B2 * 7/2005 Morgan et al. ..... 351/43
2004/0128746 A1 * 7/2004 Kuo ..... 2/428

* cited by examiner

*Primary Examiner*—Huy Mai
(74) *Attorney, Agent, or Firm*—Rabin & Berdo, P.C.

(57) ABSTRACT

This invention is directed to a device of "wide-angle diving lens", primarily comprises a lens; and characterized by: the lens is made by a main lens and extended with a plurality of different angles of sub-window lens, or at the inner edge of the lens arranged Fresnel lens, or at the outer edge of the lens chamfered with embedded joint. Accordingly, the present invention "wide-angle diving lens" not only takes advantage of the multi-angles of lens to increase visible range and enhance the structure solidity but also applies Fresnel lens to modify the light refraction angle to enlarge visible range; and further assembly conveniently as well as no visible range disrupt.

8 Claims, 13 Drawing Sheets

WIDE-ANGLE DIVING LENS

BACKGROUND OF THE INVENTION

I. Field of the Invention

When light passes through media: water, planar glass lens then air, it gets the max incident angle only around 48.61 degree. This describes why so narrow vision under water is presented to divers mounted with conventional diving mask. Efforts of the invention are related to a device of "wide-angle diving lens" especially refers to offer solutions to conquer the light physics limits. The solutions include molding planar sub-window, inner edge Fresnel prism, and lens profile ends embedded joint or their combinations. This "wide-angle diving lens" is not only increase the light incident angle to broaden the visible field but also reinforce the lens structure solidity.

II. Description of the Prior Art

The most conventional diving mask consists of plastic frame, rubber skirt and tempered glass lens; tempered glass lens generally is planar. Owning to the limits of the light physics, when light passes from high index to low index media, it will cause total reflection if the incident angle is beyond its critical incident angle. The max incident angle is only around 48.61 degree for a conventional diving mask lens. Therefore, the visible range of a diver under water is around 97.22 degree after plus two eyes' visible range. Please refer to FIG. 1, when light (as per route 1) passes within the critical incident angle, it is visible to human eyes; but when the light passes from critical incident angle (as per route 2) it will go along with the lens's surface and cannot be seen by human eyes; when light (as per route 3) passes beyond 48.61 degree critical angle, it will make reflection to form a blind zone.

Please also refer to FIGS. 2A, 2B, which show that the visible range from top and side view of conventional single planar diving lens. Divers should adjust them self several times and are very inconveniently in the water to scan the whole surroundings due to limited visional zone.

Refer to FIG. 3A to 3D, owning to the defects of the conventional lens, several improvements on diving lens was used to enlarge the visible angle. The first category of conventional improvement was to join multiple lenses with plastic frame resin into U-shape, but it always causes vision separate and shift between joints of lenses. The second category is integrally built in an arc lens, and has one dimension curved surface, but it causes faintness in the water. The third category of diving lens combines a front planar lens with an extended curved side lens, which was made by molding and used to increase the light income, but the side lens image quality is not good enough. The last category is a kind of polygonal lens, made by glued lenses, which cut the edge of lenses into a certain angle then glue them together to diminish visional fractions, but it leads to the defect of weak structure. In general case, conventional lens mounted on plastic frame will shape a plastic frame convex at the edge of lens, which will sabotage the incident light and also limit the light incident angle.

In recent years, the lens processing technique progress very fast, and the raw materials of lens become diverse, optical resin (such as PC, Acrylic, etc.) by injection, thermal setting CR39 casting to produce plastic lens appear. The above-mentioned techniques are highly matured, even the press technique of high-precision glass-mold are gradually commercialized. The high-precision glass molding machine and the high-precision glass-mold processing machines are prevalently available in the open market. Accordingly, the present invention makes use of the above-mentioned materials and techniques to manufacture molding integral "wide-angle diving lens." It not only increases light passes the lens to enlarge visible range but also strengthens the structure. In addition, Fresnel prism arranged on inner edge could be used to modify the light refraction angle to enlarge the visible range and decrease the thickness of lens.

SUMMARY OF THE INVENTION

It is therefore a primary object of the present invention to provide a diving lens with molding multi-window; it not only allows much light incident into the lens to widen the visible range but also enhances the structural solidity.

It is further object of the present invention to provide a wide-angle diving lens with Fresnel prism to modify the light incident angle through the lens in the water so as to increase the visible angle and decreasing the thickness of lens.

In addition, the present invention "wide-angle diving lens" primarily includes a lens, and characterized by: the lens made from a main lens extended with a plurality planar sub-window lens in different angles; or a lens equipped with a Fresnel prism at the proper inner edge location, and/or arranged a embedded joint at profile outer lateral edge of the lens to deprive of the conventional visional problem that caused by convex plastic frame after assembly.

Accordingly, the present invention is made from the materials such as PC, Acrylic, CR39, and glass etc. with appropriate molding technique to form a wide-angle lens. The number and angles of extended sub-window lens, Fresnel prism or embedded joint equipped or their combination will depend on the current market requirements so as to increase the light incident angle through the lens in the water and attain the purpose of broaden the visible range.

DETAILED DESCRIPTION OF THE PREFERRED EMBODIMENTS

Figure 1:
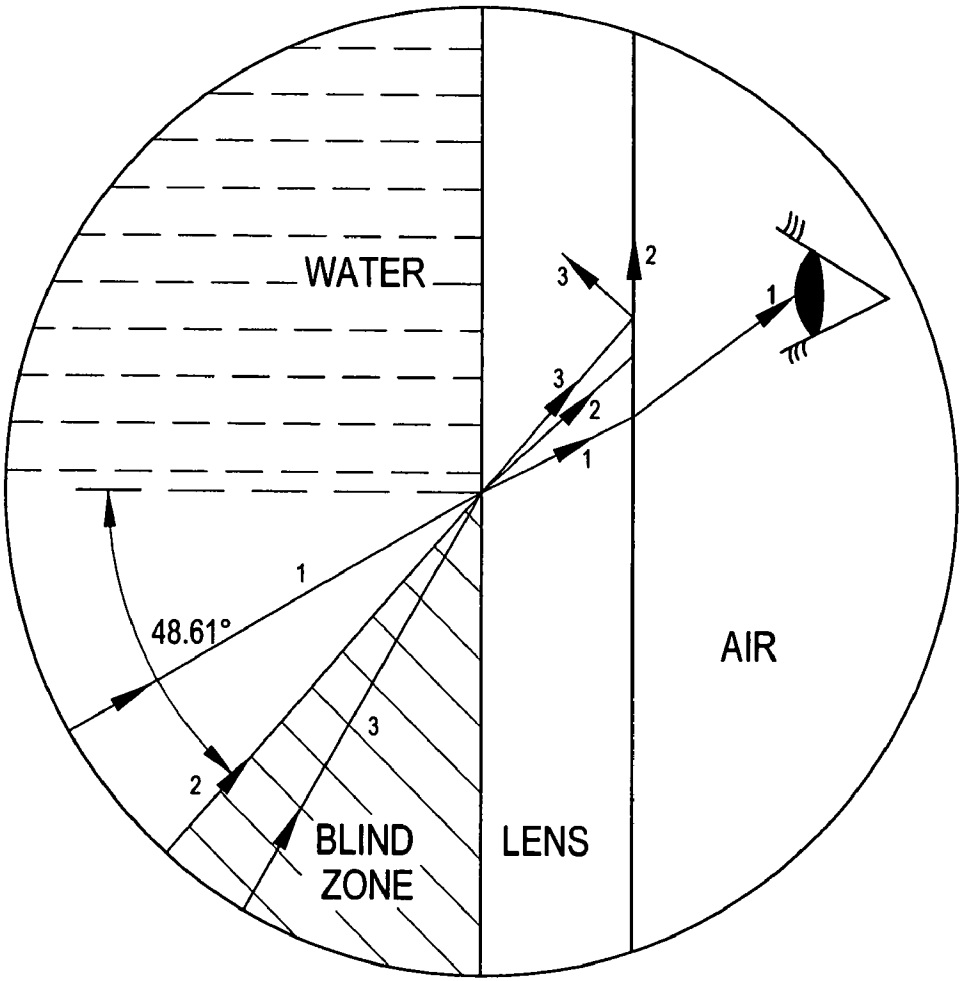
FIG. 1 view of light reflection path through different media
Figure 2B:
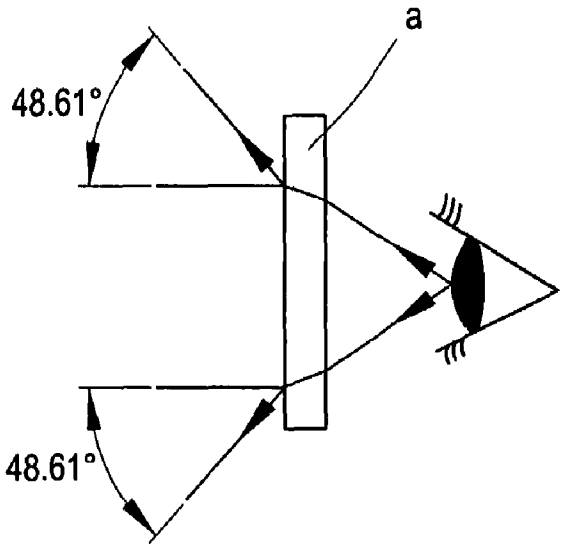
Fig.2B(PRIOR ART)
FIGS. 2A, 2B visible range of conventional diving lens
Figure 2A:
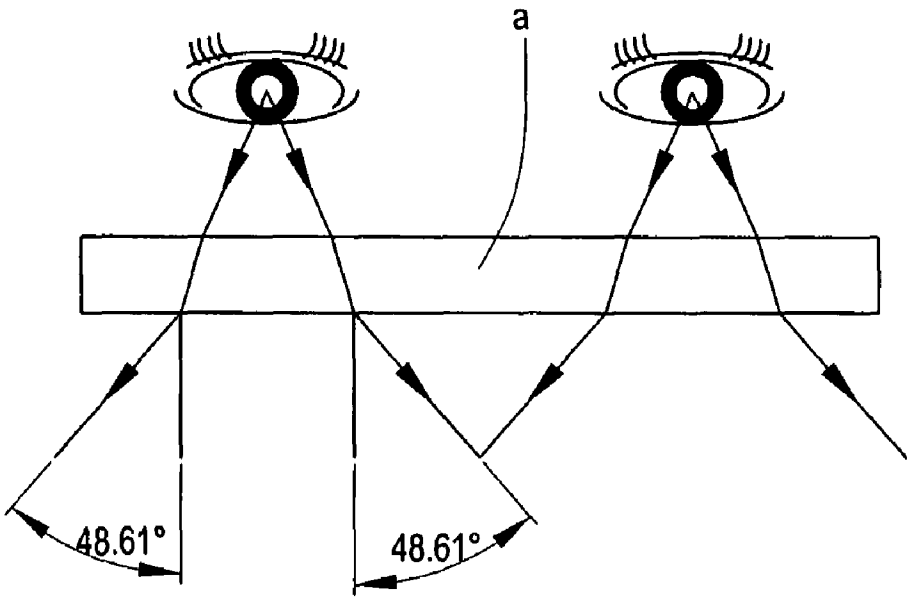
Fig.2A(PRIOR ART)
Figure 3A:
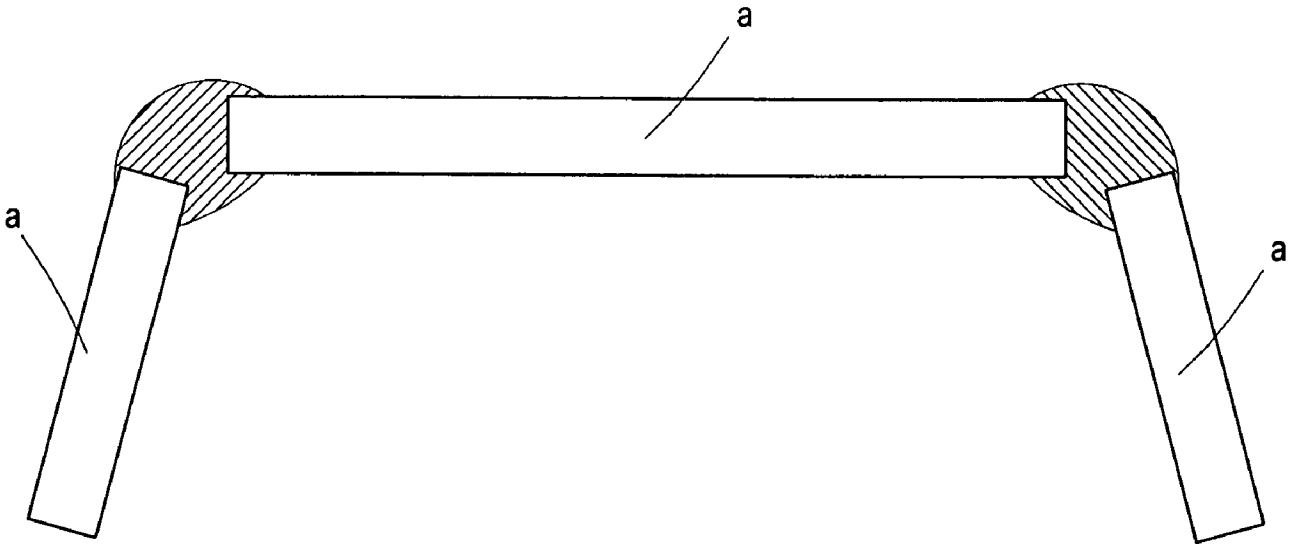
Fig.3A(PRIOR ART)
FIG. 3A-3D structure of conventional diving lens
Figure 3B:
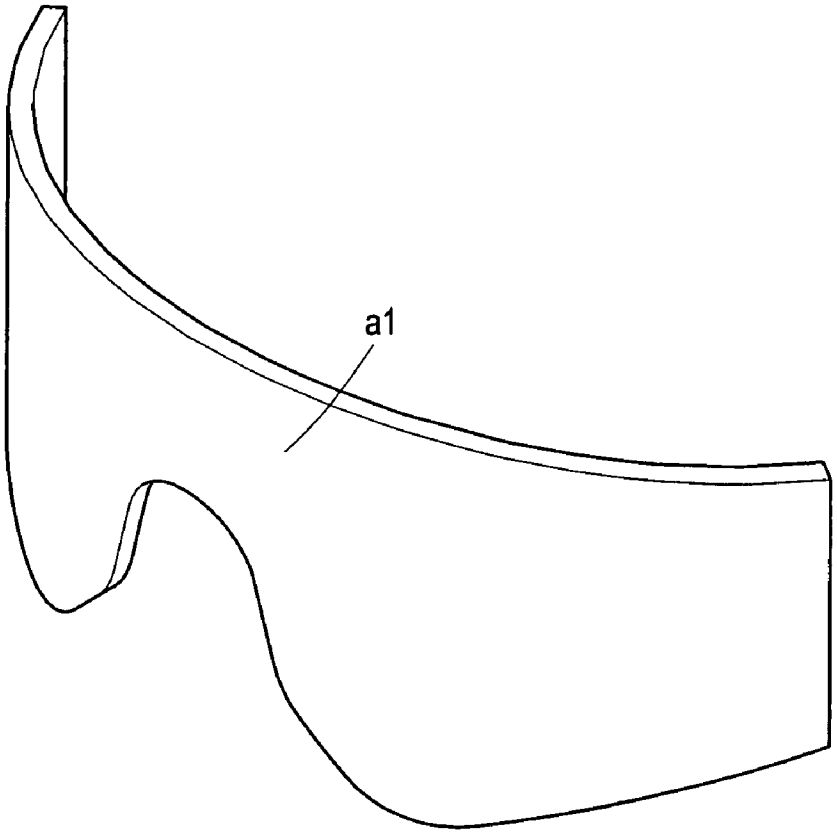
Fig.3B(PRIOR ART)
Figure 3C:
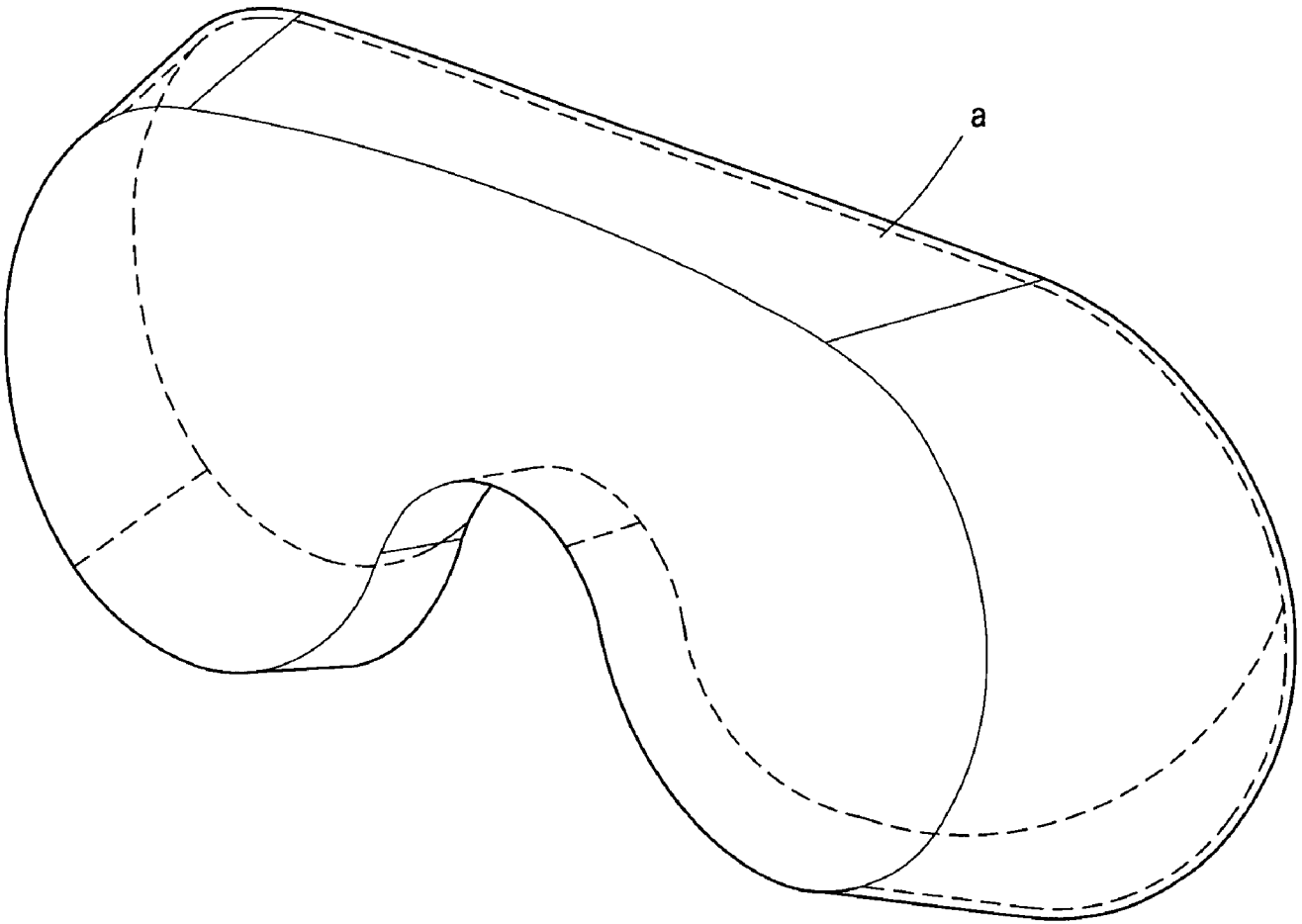
Fig.3C (PRIOR ART)
Figure 3D:
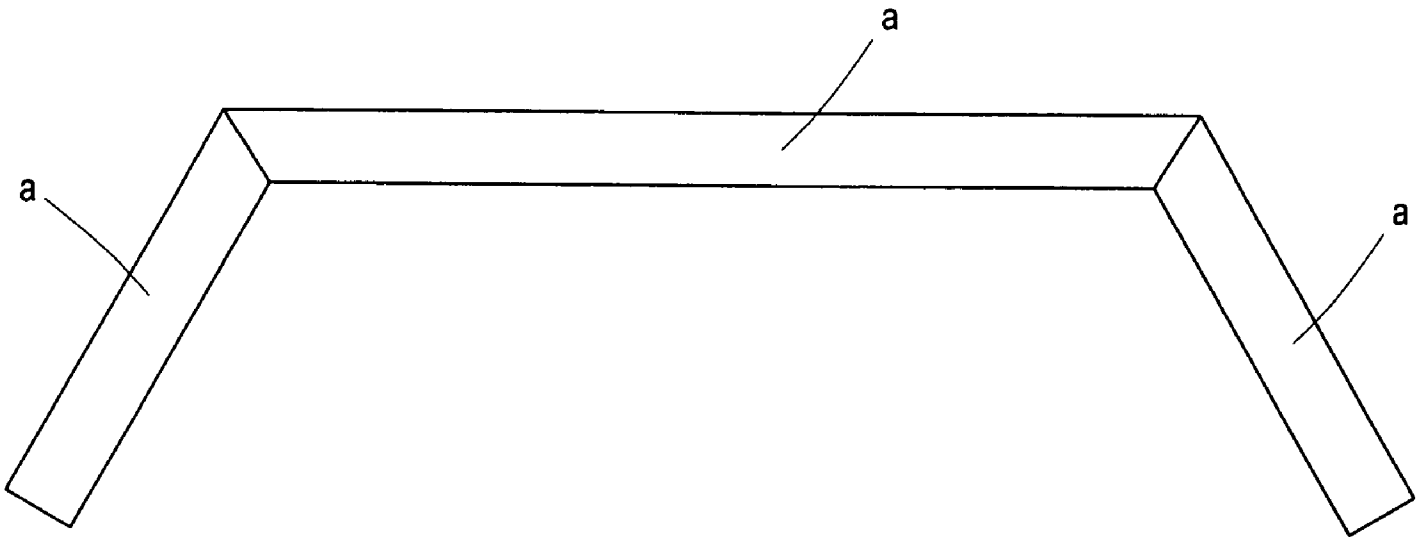
Fig.3D(PRIOR ART)
Figure 4:
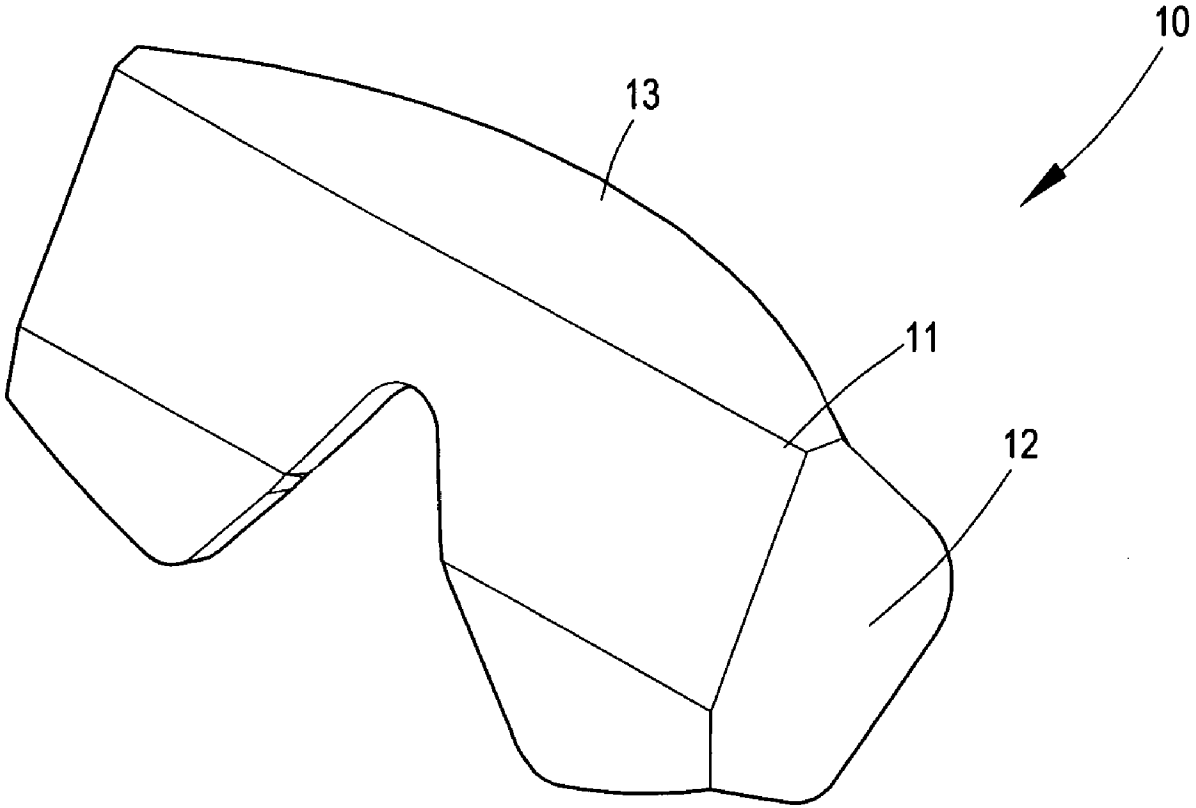
FIG. 4 perspective view of multi-window lens of the present invention
Figure 5:
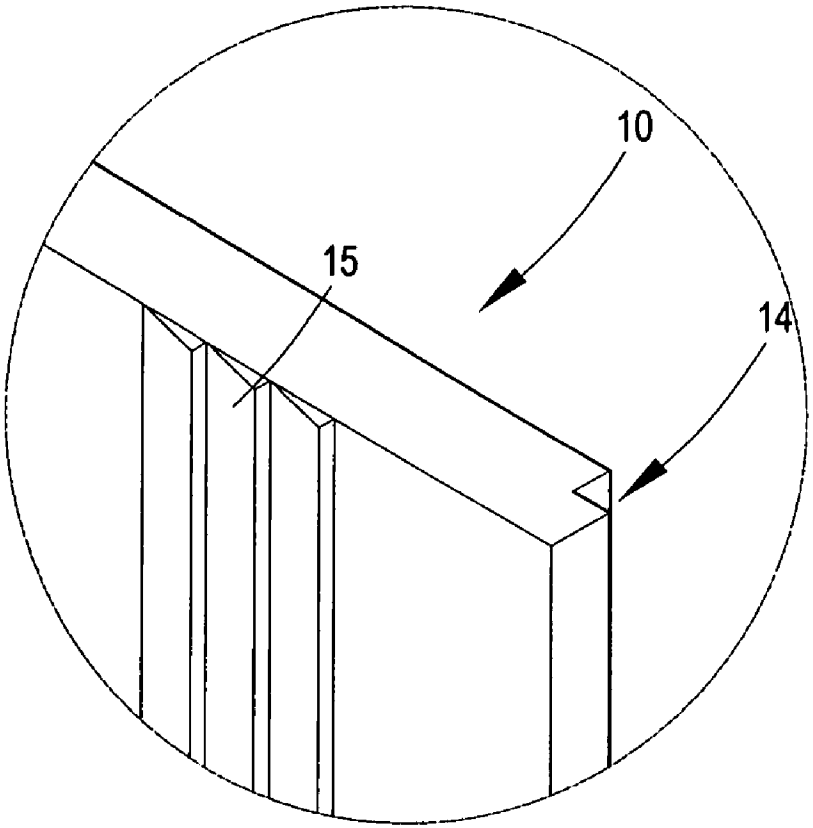
FIG. 5 perspective view of the present invention of the conventional lens equipped with Fresnel prism lens FIG. 6A cross-sectional view of the combination of conventional lens and plastic frame FIG. 6B cross-sectional view of the combination of plastic frame and lens of the present invention FIGS. 7A, 7B deployment angle view of the present invention in addendum of left/right lens and upper/bottom lens FIG. 8 refraction path view of the light pass through the Fresnel prism

If a mask main lens is extended with left/right 20 degree sub-window lens it will get visible range up to 237.22 degree; extended with upper/lower 35 degree sub-window lens incident light will increases up to 207.22 degree totally. Because of the limitation of human face curve, a man could only need around 180 degree of visible range in upper and lower range portions, therefore, according to the above-mentioned description, the lens enables 237.22 degree of horizontal visible range and 180 degree of vertical visible range, and the integral manufacture strengthens product solidity. Even so, the multi-window lens is still limited by light physics for each window's max incident angle is the same round 48.61 degrees.

Furthermore, in accordance with the characteristic of each material, Fresnel prism arranged on the edge of lens; for example, at the inner side of glass lens arranged a 20-degree prism, it will get 90 degree of incident angle based on optical rule. Hence, a 180 degree of visible range will be attained if setting up two prisms at both sides of lens, and change the light refraction angles in the water to meet the requirement of increasing visible range, decreasing the thickness of lens and the number of sub-window lens. Whereas; when arranged the Fresnel prism on the left and right edge of sub-window lens, it can have the largest visible range around to 320 degree of incident angle after calculating. Once now the light incident angle can be 90 degree after equipped with Fresnel prism, but conventional mask assembly way that leads convex plastic part edge will cause light incident limit at this time.

So while chamfer the lens profile outer edge it can set up embedded joint for assembly which is used to quickly connect plastic frame and rubber skirt to form a planar interface without convex edge of plastic frame and influences the incident angle so to get the light incident angle 90 degree.

Referring to FIGS. 4, 5, 7A, 7B, 8, the present invention "Wide-angle diving lens" comprises a lens 10, and characterized by:

The lens 10 is built integrally and comprises one main lens 11 with extended multiple planar sub-window lens 12, 13 in different angles. The angle α between main lens 11 and right/left lens portions 12 ranges from 10 to 30 degree, and the β angle between main lens and upper/bottom planar sub-window lens 13 ranges from 35 to 70 degree, and the embedded joint 14 set up at the profile outside ends for assembly purpose; while the other method is to set up Fresnel prism at the inner sides (left/right and or up/down) of lens 10, and the angle γ between Fresnel prism and lens 10 ranges from 10 to 30 degree, then set up the embedded joint 14 at the outer side of the lens 10 for assembly purpose.

Figure 6A:
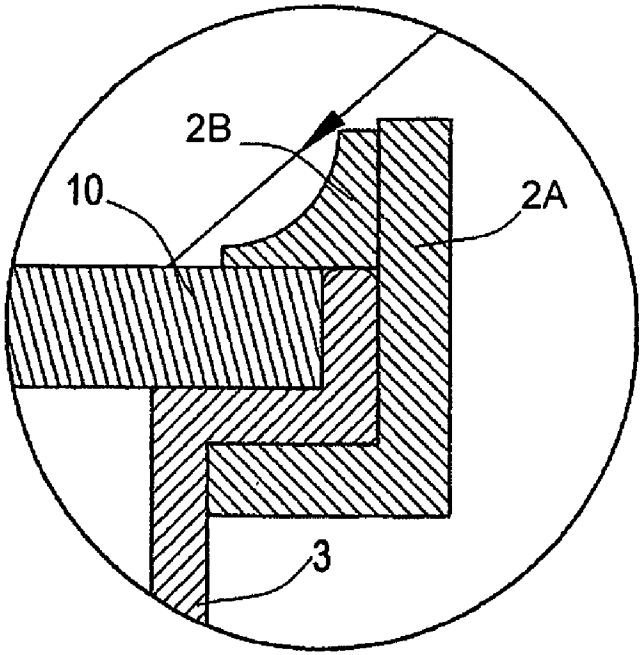
Fig.6A(PRIOR ART)
Figure 6B:
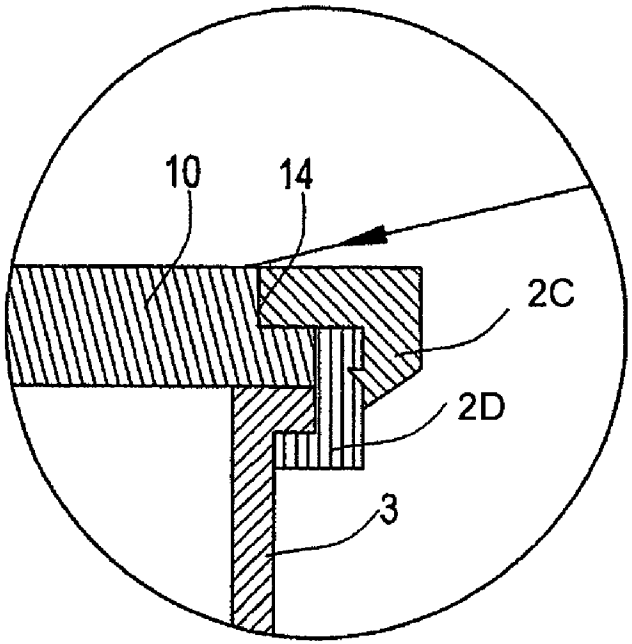

Referring to FIGS. 6A & 6B, they are cross-sectional views of a conventional diving lens and the present invention. The combination of the rubber pad 3, plastic frame members 2A and 2B, and conventional diving lens 10 will form a plastic frame with convex at the edge of lens 10 which will cause the disruption of light refractions and limit the light incident angle; at the edge of lens 10 fixed with embedded joint 14 which could speed up the assembly with plastic frame members 2C and 2D and rubber pad 3 without having convex plastic frame 2B to disrupt the light incident angle.

Figure 7A:
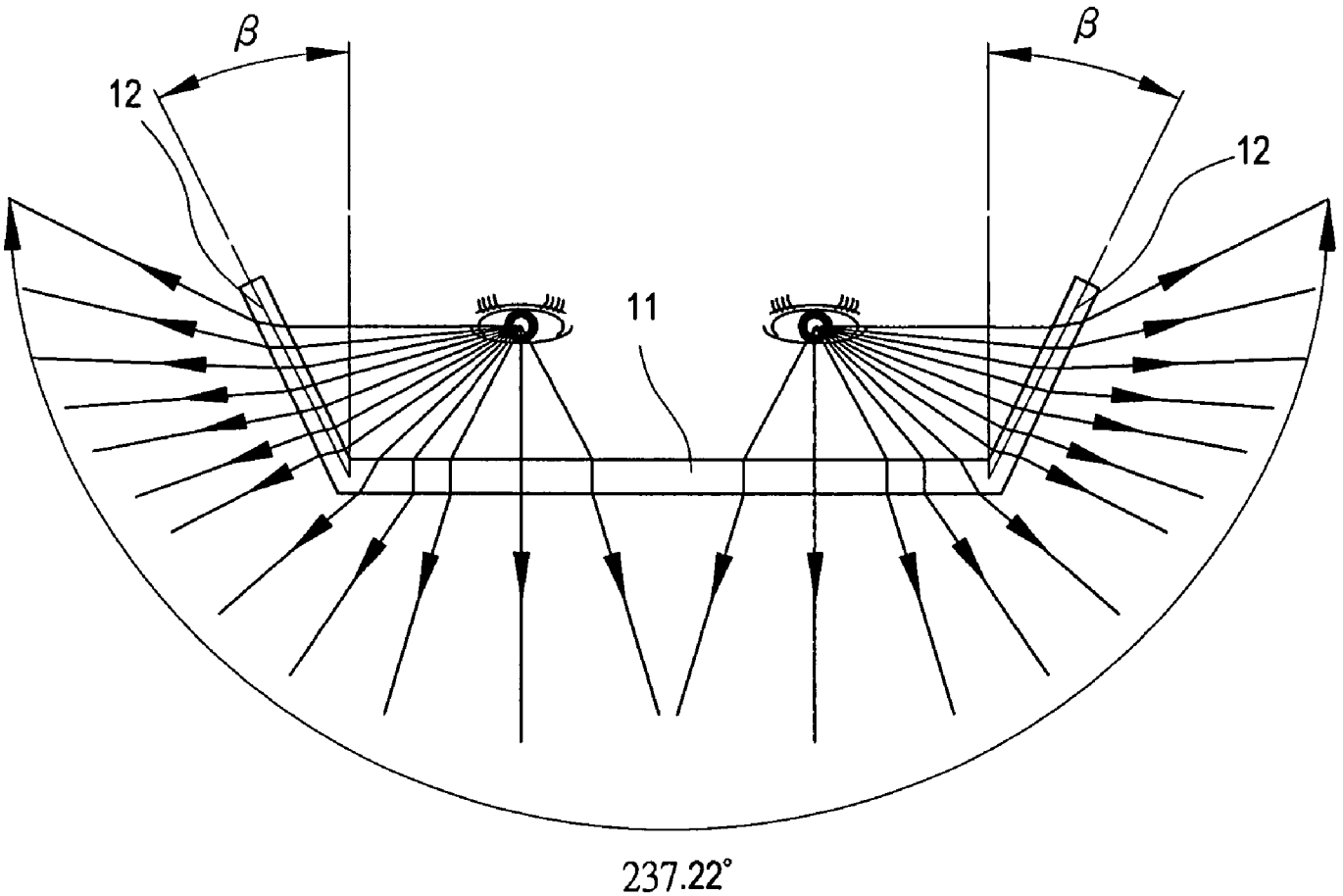
Figure 7B:
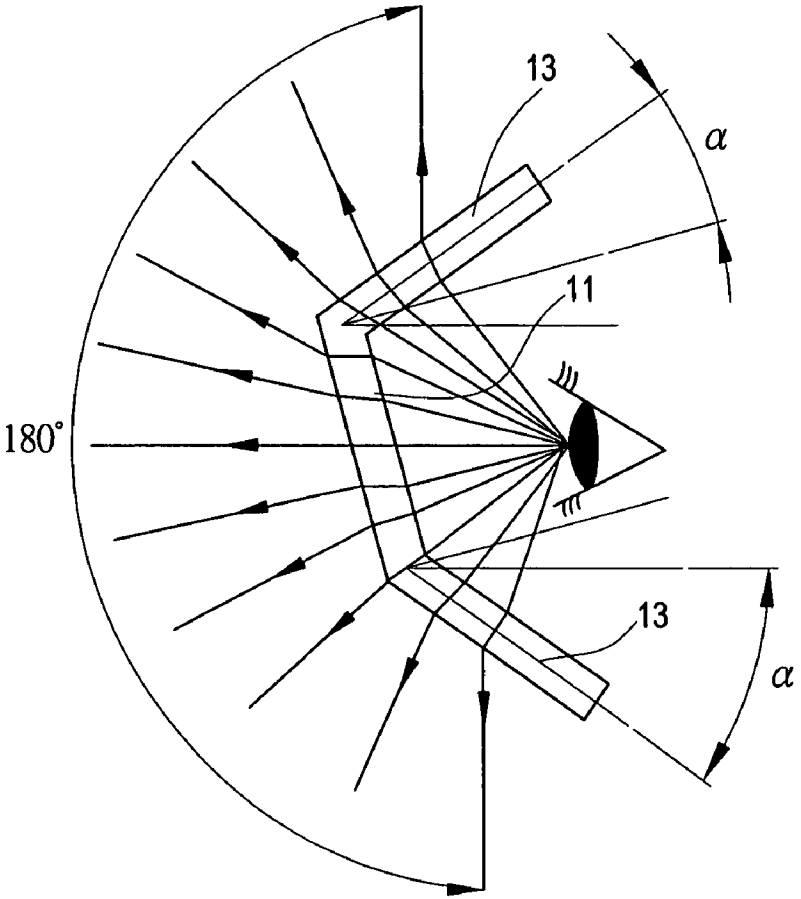
Figure 8:
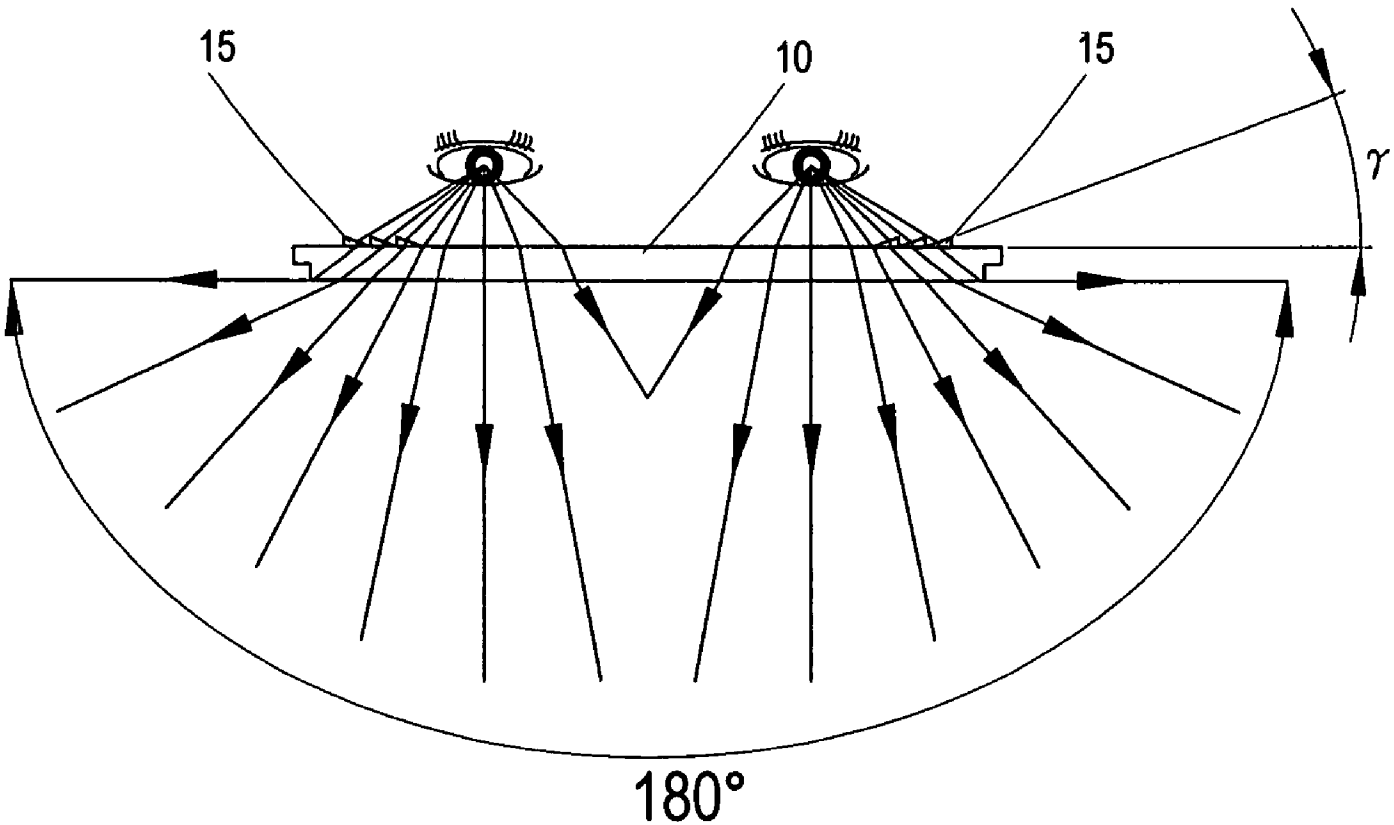

Referring to FIGS. 7A, 7B, the angle and deployment view between left/right extended planar sub-window lens, and upper/bottom extended planar sub-window lens of the present invention. When the angle α between main lens 11 and left/right lens portions is about 20 degree, and the angle β between main lens 11 and upper/bottom extended lens portions 12 is around to thirty-five degree, the highest available visible range of the lens is around to horizontal 237.22 degree, and upper/bottom visible range around to 180 degree. Please also refer to FIG. 8, apply Fresnel prism 15 to modify the light refractions in the water, the appropriate location of the inner side of the lens 10 set up 20 degree Fresnel prism to gain the effect of 90 degree of incident angle; i.e., a single lens with Fresnel prism on its two sides to gain the effect of visible range at 180 degree.

In summary, the present invention is related to "a wide-angle diving lens", to gain the purpose of not only increase incident angle to increase the visible field, but also reinforce the effect of structural solidity.

Many changes and modifications in the above-described embodiments of the invention can, of course, be carried out without departing from the scope thereof. Accordingly, to promote the progress in science and the useful arts, the invention is disclosed and is intends to be limited only by the scope of the appended claim.

What is claimed is:

1. A wide-angle diving lens, comprising:

a lens body made of homogenous material, the lens body including a main window and a plurality of sub-windows that are integrally connected to the main window, the main window having a planar portion and the sub-windows having planar portions, wherein the main window has a top side, a bottom side, a left side, and a right side, and wherein the sub-windows include a top sub-window connected to the top side of the main window, a bottom sub-window connected to the bottom side of the main window, a left sub-window connected to the left side of the main window, and a right sub-window connected to the right side of the main window.

2. The wide-angle diving lens of claim 1, wherein an angle between the planar portion of the main window and the planar portion of the top sub-window ranges from about 35° to about 70°, and an angle between the planar portion of the main window and the planar portion of the bottom sub-window likewise ranges from about 35° to about 70°.

3. The wide-angle diving lens of claim 2, wherein an angle between the planar portion of the main window and the planar portion of the left sub-window ranges from about 10° to about 30°, and an angle between the planar portion of the main window and the planar portion of the right sub-window likewise ranges from about 10° to about 30°.

4. The wide-angle diving lens of claim 1, wherein an angle between the planar portion of the main window and the planar portion of the left sub-window ranges from about 10° to about 30°, and an angle between the planar portion of the main window and the planar portion of the right sub-window likewise ranges from about 10° to about 30°.

5. A wide-angle diving lens, comprising:

a lens body made of homogenous material, the lens body including a main body with side portions and Fresnel prisms integrally joined to the main body at the side portions.

6. The wide-angle diving lens of claim 5, wherein the main body has a central portion between the side portions, Fresnel prisms being absent from the central portion.

7. The wide-angle diving lens of claim 6, wherein each Fresnel prism has a side that is oriented with respect to the central portion at an angle ranging from about 10° to about 30°.

8. The wide-angle diving lens of claim 6, where in the Fresnel prisms are straight rather than curved.

* * * * *